United States Patent [19]

Fukuhara et al.

[11] Patent Number: 4,702,769

[45] Date of Patent: Oct. 27, 1987

[54] SINTERED ALLOY FOR DECORATION

[75] Inventors: Mikio Fukuhara, Tokyo; Tetsuya Mitsuda, Kawasaki, both of Japan

[73] Assignee: Toshiba Tungaloy Co., Ltd., Japan

[21] Appl. No.: 474,813

[22] Filed: Mar. 10, 1983

[30] Foreign Application Priority Data

May 21, 1982 [JP] Japan ..... 57-86234
May 21, 1982 [JP] Japan ..... 57-86235

[51] Int. Cl.[4] ..... C22C 29/02; C22C 29/12; C22C 29/16

[52] U.S. Cl. ..... 75/233; 75/239; 75/240; 75/241; 75/244

[58] Field of Search ..... 75/233, 236, 239, 240, 75/241, 244, 232, 238, 245

[56] References Cited

U.S. PATENT DOCUMENTS

| | | | |
|---|---|---|---|
| 3,684,463 | 8/1972 | Koelbl | 29/182.8 |
| 3,813,227 | 5/1974 | Tomita et al. | 75/245 |
| 4,290,807 | 9/1981 | Asai et al. | 75/233 |
| 4,375,517 | 3/1983 | Watanabe et al. | 501/96 |
| 4,422,874 | 12/1983 | Nishimura et al. | 75/238 |
| 4,449,039 | 5/1984 | Fukazawa et al. | 219/541 |
| 4,457,780 | 7/1984 | Osada et al. | 75/236 |

FOREIGN PATENT DOCUMENTS

| | | | |
|---|---|---|---|
| 1591774 | 6/1970 | France | 75/238 |
| 47844 | 3/1982 | Japan | 75/238 |
| 104646 | 6/1982 | Japan | 75/238 |
| 61252 | 4/1983 | Japan | 75/238 |
| 1384754 | 2/1975 | United Kingdom . | |
| 609338 | 10/1980 | U.S.S.R. | 75/238 |

OTHER PUBLICATIONS

Modern Developments in Powder Metallurgy, volume 5, pp. 201 to 214, Materials and Properties, edited by Henry H. Hausner, published by Prenum Press, New York–London, 1971.

Hausner, Antes and Smith, eds., Modern Developments in Powder Metallurgy, vol. 14, pp. 347–362, published in 1981 by the Metal Powders Indus. Fed. (Princeton, N.J.)

Fukuhara and Mitani, "The Phase Relationship and Denitrification during the Sintering Process of TiN–Ni Mixed Powder Compacts," pp. 211–217, vol. 14, published by Japan Institute of Metals (Sendai) in Apr. 1980).

*Primary Examiner*—John F. Terapane
*Assistant Examiner*—Eric Jorgensen
*Attorney, Agent, or Firm*—Schwartz, Jeffery, Schwaab, Mack, Blumenthal & Evans

[57] ABSTRACT

There is disclosed a sintered alloy for decoration comprising 2 to 30% by weight of a binding phase comprising one or more elements selected from the group consisting of Fe, Ni, Co, Cr, Mo and W;

0 to 10% by weight of a strengthening phase comprising one or more material selected from the group consisting of a metal, an alloy, a metal oxide, a metal nitride and a metal carbide;

the balance of a hard phase represented by the formula:

$$(Ti_a, M_b)(N_w, C_x, O_y)_z$$

(wherein M, A, b, w, x, y and z are defined in the specification); and inevitable impurities.

The sintered alloy for decoration according to this invention possesses both a decorativeness suitable for decorative members as well as excellent corrosion resistance and mechanical properties.

8 Claims, No Drawings

SINTERED ALLOY FOR DECORATION

BACKGROUND OF THE INVENTION

This invention relates to sintered alloys for decoration, having both decorativeness and wear resistance, suitable for decorative members such as external parts for watches, tiepins, brooches, parts for fishing tackles and so on.

For decorative members that are required to have corrosion resistance and to be scratch proof, sintered alloys utilizing WC, TaC and TiC as base materials have been put to practical use. Among these, the WC base and TaC base sintered alloys are unsuitable for portable decorations on account of high cost and great specific gravity, and they have the defect that they cannot satisfy requirements for decorative effects completely, because of having simple blackish gray colors. In order to improve the decorativeness, steels or sintered alloys coated with TiN and/or TiC have been used. These coated alloys, however, still have disadvantages of impairing decorative value. For exmple, there are disadvantages of tone difference between inside and outside of the coated alloys because of the nonuniformities of coating properties and thickness of coating film which are brought about during manufacturing processes. Further, a great number of sintered alloys including TiN as a main component have been proposed to comprise colored sintered alloy members for decoration, but they are very bad in sintering effect. Since such alloys having poor sintering effect are not suitable for decorative members even if a polishing treatment such as lapping will be undergone. Therefore, they have not been put to practical use yet.

The sintered alloy for decoration according to this invention has now been accomplished in order to overcome the aforementioned drawbacks and problems.

SUMMARY OF THE INVENTION

An object of this invention is to provide a sintered alloy for decoration, having both decorativeness and corrosion resistance, suitable for decorative members.

When a mixed powder compact which comprises a material including, as a main component, TiN in a proportion near to its stoichiometric composition and an iron family element is sintered, the TiN is dissolved in the iron family element to form an iron family solid solution. At that time, Ti atom and N atom in TiN cannot be dissolved in the iron family element with equivalent molar ratio, and 95% or more of the nitrogen is liberated from the mixed powder compact in the form of $N_2$ gas. Therefore, after a liquid phase has appeared, there occurs the phenomenon that the $N_2$ gas is retained therein, so that densification of the compacts is remarkably disturbed. Now, investigations have been carried out to prevent the denitrification which results from such a phenomenon, and as a result, the sintered alloy for decoration according to this invention has been completed.

DETAILED DESCRIPTION OF PREFERRED EMBODIMENTS

The sintered alloy for decoration according to this invention comprises:

2 to 30% by weight of a binding phase comprising one or more elements selected from the group consisting of Fe, Ni, Co, Cr, Mo and W;

0 to 10% by weight of a strengthening phase comprising one or more material selected from the group consisting of a metal, an alloy, a metal oxide, a metal nitride and a metal carbide;

the balance of a hard phase represented by the formula:

$$(Ti_a, M_b)(N_w, C_x, O_y)_z$$

(wherein M is one or more elements selected from the group consisting of Zr, Hf, V, Nb, Ta and Cr; a is an atomic ratio of the Ti; b is an atomic ratio of a metal represented by M; $a+b=1$; $1 \geqq a \geqq 0.4$; $0.6 \geqq b \geqq 0$; N is nitrogen; C is carbon; O is oxygen; w, x and y are atomic ratios of the nitrogen, carbon and oxygen, respectively; z is a ratio of non-metallic elements with respect to the metals; $w+x+y=1$; $x+y>0$; $1>w \geqq 0.4$; $0.5 \geqq x \geqq 0$; $0.6 \geqq y \geqq 0$; and $0.95 \geqq z \geqq 0.6$); and inevitable impurities.

To obtain, in a sintering process, the effect of improving the acceleration of the sintering function and the denseness of the sintered alloy by lowering a liquid phase-appearing temperature of the binding phase and the effect of improving the strength and hardness of the sintered alloy by producing an intermetallic compound or a solid solution, the above-described alloy according to this invention can include one or more metals selected from the group consisting of P, Al, B, Si, Mn, Ti, Zr, Hf, V, Nb and Ta, alternatively one or more alloys thereof, for the strengthening phase. Thereby, the strengthening phase comprising such a metal or alloy will contribute to the improvement in the strength, scratch proof and corrosion resistance of the sintered alloy. Further, for the purpose of improving the strength and hardness of the sintered alloy by dispersing a material into the binding phase, one or more oxides selected from the group consisting of $Al_2O_3$, $Y_2O_3$, $ZrO_2$, MgO, NiO and $SiO_2$ can be used for the strengthening phase. The strengthening phase containing such an oxide will contribute to the improvement in the strength, scratch proof and corrosion resistance of the sintered alloy. Furthermore, for the purpose of increasing the bond strength between the hard phase and the binding phase by strengthening boundaries between particles of the surrounding phases, one or more nitrides or carbides selected from the group consisting of AlN, $Si_3N_4$, BN and $Mo_2C$, alternatively one or more double compounds thereof can be used for the strengthening phase. The strengthening phase containing such a material will contribute to the improvement in the strength, scratch proof and corrosion resistance of the sintered alloy.

In the sintered alloy according to this invention, since the TiNz ($0.95 \geqq z \geqq 0.6$) powder having substoichiometric composition is used as a starting material, there occurs the phenomenon that liberated $N_2$ gas, which would be exhausted out of the system, inversely nitrogenizes the TiNz powder. As a result, the denitrification which would be brought about during the sintering process of the powder compact including TiN as a main component can be prevented. Moreover, according to this invention, carbon and/or oxygen may be added to the TiNz to produce $(Ti_a, M_b)(N_w, C_x, O_y)_z$, which increases the effect of preventing the denitrification. And at the same time, densification can be accelerated, and the denseness, strength and hardness of the sintered product can be increased, since the carbide of the metal element which has large valence electron number in (Tia, Mb) (Nw, Cx, Oy)z precipitates in the process of sintering, and the carbide had good wettability with an iron family element. By virtue of the synergistic effect which can be created by the use of the hard phase and the strengthening phase, the strength and hardness of the sintered alloy will be further heightened, whereby there can be obtained the sintered alloy excellent in wear resistance, scratch proof and corrosion resistance.

The sintered alloy for decoration according to this invention can retain the tone of a gold color series with the aid of the hard phase in which the TiNz is mainly included. In this case, as a numerical value of the z of TiNz becomes less than that of its stoichiometric composition, the sintered alloy will change from a gold color toward a light gold color. When there is added to the sintered alloy one or more compounds of TiO, ZrN, HfN, VN, NbN, TaN, CrN, $Cr_2N$, TaC and NbC which serve to additionally provide the sintered alloy with a golden tone, the control of the tone can easily be carried out ranging from a profound light gold color to a clear gold color.

The sintered alloy for decoration according to this invention can be obtained in an enough dense state under a pressureless sintering in vacuo or in a non-oxidizing atmosphere. In addition, when it is reheated by a hot isostatic pressing method (HIP), it can be prepared in a much denser and stronger state.

The elements constituting the sintered alloy for decoration according to this invention are numerically restricted for the following reasons:

In the (Tia, Mb) (Nw, Cx, Oy)z, which the hard phase comprises, a metal M other than the Ti has not only the effect of grain size control of the hard phase but also the effect of heightening the strength and hardness of the hard phase. Particularly in the case that the metal M is added in the form of one or more compounds, selected from the group consisting of CrN, ZrN, HfN, VN, NbN, TaN and $Cr_2N$, which provide a gold color series, the atomic ratios a and b of the Ti and M can be selected from a wide range to prepare a desired alloy. Although there is not any substantial reason to restrict these atomic ratios, it is necessary to take weight-saving for portability and scratch resistance into consideration, and when there is added thereto a carbide such as ZrC, HfC, VC, NbC, TaC or $Cr_3C_2$, tone must also be taken into consideration. Accordingly, these ratios should be set to $1 \geqq a \geqq 0.4$ and $0.6 \geqq b \geqq 0$. With regard to the non-metallic elements N, C and O, the N can be mainly used for the sake of obtaining a golden sintered alloy, and one or both of the C and O can be used for the acceleration of the sintering effect and the improvement in the scratch proof. However, when an amount thereof is excessive, not only the sintering effect but also the hardness of the sintered alloy will be deteriorated. Accordingly, the ratios w, x and y of the non-metallic elements, N, C and O, should be set to $1 > w \geqq 0.4$, $0.5 \geqq x \geqq 0$ and $0.6 \geqq y \geqq 0$. In this case, the carbon C should be added in the form of free carbon rather than a metallic carbide, since the former has a more intensive effect of accelerating the sintering effect than the latter. The ratio z of the non-metallic element to the metallic element must be less than the stoichiometric ratio for the sake of preventing degasification and improving the hardness of the sintered alloy, but when it is too small, an obtained compound will be unstable and the dimensional accuracy of the sintered alloy will be poor. Accordingly, it is concluded that the ratio z should be set to the range of $0.95 \geqq z \geqq 0.6$.

An amount of the binding phase depends on a relation between amounts of the hard phase and the strengthening phase, and further on a use of the product. However, when the binding phase is contained in an amount less than 2% by weight, the sintering effect and denseness will degrade, on the contrary, when it is contained in an amount more than 30% by weight, the hardness of the sintered alloy will deteriorate and thus the scratch resistance will be poor. Accordingly, the amount of the binding phase should be within the range of 2 to 30% by weight.

An amount of the strengthening phase depends on the amount of the used binding phase and a usage of the product. When it exceeds 10% by weight, the sintering effect will be decrease and the sintered alloy will be brittle. Accordingly, the amount of the strengthening phase should be set to the range of 0 to 10% by weight.

Now, the sintered alloy for decoration according to the present invention will be described in detail with reference to the examples, as follows:

EXAMPLE 1

TiNz, TiC, TiO, Ti(Nw, Cx)z, Ti(Nw, Oy)z and Ti(Nw, Cx, Oy)z were each blended with a metallic powder of the binding phase in a predetermined proportion, and 2% by weight of paraffin was further added thereto as a lubricant. Each blend thus prepared was ground and mixed in a ball mill in which acetone was used as a solvent. After drying, each resultant mixed powder was compacted at a pressure of 2 t/cm$^2$, and was then sintered under a vacuum of $10^{-3}$ to $10^{-4}$ mmHg and at a given temperature of 1400° to 1600° C. Each sintered alloy was polished by means of a diamond grinding wheel, and it was tested for mechanical properties, tones and corrosion resistance. With regard to the mechanical properties, hardness and transverse rupture strength were measured, and the test of the corrosion resistance was carried out by observing the polished surface of each sample after it was dipped in an artificial sea-water and an artificial sweat at 50° C. for a period of 7 days. Blend composition and sintering conditions of each sample are shown in Table 1, and results of the mechanical properties, tone and corrosion resistance of each sample are presented in Table 2:

TABLE 1

| Sample No. | Blend composition (wt. %) | Sintering conditions |
|---|---|---|
| 1 | 47.5% $TiN_{0.85}$ - 47.5% TiO - 5% Ni | 1500° C. - 1 hr |
| 2 | 90% $TiN_{0.70}$ - 5% TiO - 5% Ni | " |
| 3 | 90% $TiN_{0.70}$ - 5% TiC - 4.5% Co - 0.5% C | " |
| 4 | 80% $TiN_{0.70}$ - 5% TiO - 5% TiC - 5% Ni - 5% $Mo_2C$ | 1450° C. - 1 hr |
| 5 | 95% Ti $(N_{0.95}, O_{0.05})_{0.85}$ - 5% Ni | 1500° C. - 1 hr |
| 6 | 90% Ti $(N_{0.80}, O_{0.20})_{0.70}$ - 5% Ni - 5% Cr | 1450° C. - 1 hr |
| 7 | 80% Ti $(N_{0.70}, O_{0.30})_{0.60}$ - 10% Ni - 5% Mo - 5% Cr | " |
| 8 | 95% Ti $(N_{0.95}, C_{0.05})_{0.90}$ - 4.9% Ni - 0.1% C | 1550° C. - 1 hr |
| 9 | 90% Ti $(N_{0.90}, C_{0.10})_{0.75}$ - 5% Ni - 5% W | " |
| 10 | 80% Ti $(N_{0.85}, C_{0.15})_{0.60}$ - 10% Ni - 5% Co - 5% Cr | 1450° C. - 1 hr |

TABLE 1-continued

| Sample No. | Blend composition (wt. %) | Sintering conditions |
|---|---|---|
| 11 | 95% Ti $(N_{0.85}, C_{0.05}, O_{0.10})_{0.90}$ - 4.8% Ni - 0.2% C | 1500° C. - 1 hr |
| 12 | 90% Ti $(N_{0.70}, C_{0.10}, O_{0.20})_{0.80}$ - 5% Co - 5% Cr | " |
| 13 | 80% Ti $(N_{0.65}, C_{0.05}, O_{0.30})_{0.65}$ - 10% Ni - 5% $Mo_2C$ - 5% Cr | 1450° C. - 1 hr |

TABLE 2

| | Mechanical properties | | | Corrosion resistance | |
|---|---|---|---|---|---|
| Sample No. | Transverse rupture strength (Kg/mm$^2$) | Hardness (HRA) | Tone | Artificial sea-water | Artificial sweat |
| 1 | 105 | 90.5 | Reddish gold color | Not color-changed nor corroded | Not color-changed nor corroded |
| 2 | 110 | 90.8 | Gold color | Not color-changed nor corroded | Not color-changed nor corroded |
| 3 | 115 | 90.3 | Light gold color | Extremely slightly color-changed | Not color-changed nor corroded |
| 4 | 100 | 90.2 | Reddish light gold color | Not color-changed nor corroded | Not color-changed nor corroded |
| 5 | 105 | 91.0 | Gold color | Not color-changed nor corroded | Not color-changed nor corroded |
| 6 | 110 | 90.5 | Reddish light gold color | Not color-changed nor corroded | Not color-changed nor corroded |
| 7 | 115 | 90.0 | Light gold color | Not color-changed nor corroded | Not color-changed nor corroded |
| 8 | 107 | 90.6 | Gold color | Not color-changed nor corroded | Not color-changed nor corroded |
| 9 | 103 | 90.8 | Reddish light gold color | Extremely slightly color-changed | Not color-changed nor corroded |
| 10 | 117 | 90.1 | Reddish light gold color | Not color-changed nor corroded | Not color-changed nor corroded |
| 11 | 110 | 91.2 | Gold color | Not color-changed nor corroded | Not color-changed nor corroded |
| 12 | 108 | 91.0 | Reddish gold color | Not color-changed nor corroded | Not color-changed nor corroded |
| 13 | 115 | 91.1 | Reddish light gold color | Not color-changed nor corroded | Not color-changed nor corroded |

EXAMPLE 2

ZrN, TaN, TaC, NbC, ZrC, VC, HfN, CrN, (Tia, Mb)Nz, (Tia, Mb) (Nw, Cx)z, (Tia, Mb) (Nw, Oy)z and (Tia, Mb) (Nw, Cx, Oy)z were mixed with the powdery materials which were used in Example 1, in a predetermined proportion, and each sintered alloy was prepared in the same manner as in Example 1. Each sintered sample was then tested for mechanical properties, tone and corrosion resistance as in Example 1. Blend composition and sintering conditions of each sample are shown in Table 3, and the mechanical properties, tone and corrosion resistance of each sample are presented in Table 4:

TABLE 3

| Sample No. | Blend composition (wt. %) | Sintering conditions |
|---|---|---|
| 14 | 85% $TiN_{0.70}$ - 5% ZrN - 5% TiO - 5% Ni | 1550° C. - 1 hr |
| 15 | 80% $Ti(N_{0.8}, O_{0.2})_{0.70}$ - 10% TaN - 5% Ni - 5% $Mo_2C$ | 1600° C. - 1 hr |
| 16 | 81% $Ti(N_{0.95}, O_{0.05})_{0.85}$ - 2% HfN - 2% $Mo_2C$ - 5% VC - 10% Ni | 1550° C. - 1 hr |
| 17 | 90% $Ti(N_{0.80}, O_{0.20})_{0.70}$ - 5% NbC - 4.8% Co - 0.2% C | " |
| 18 | 80% $Ti(N_{0.65}, C_{0.05}, O_{0.30})_{0.65}$ - 10% CrN - 5% Ni - 5% Cr | " |
| 19 | 75% $Ti(N_{0.5}, O_{0.5})_{0.75}$ - 20% $(V_{0.5}, Ta_{0.5})C$ - 5% Ni | 1500° C. - 1 hr |
| 20 | 90% $(Ti_{0.9}, Hf_{0.1})$ $(N_{0.95}, C_{0.05})_{0.70}$ - 5% Co - 5% Ni | " |
| 21 | 90% $(Ti_{0.9}, Ta_{0.1})$ $(N_{0.8}, C_{0.1}, O_{0.1})_{0.70}$ - 5% Ni - 5% Mo | " |
| 22 | 95% $(Ti_{0.9}, Zr_{0.1})$ $(N_{0.8}, C_{0.1}, O_{0.1})_{0.80}$ - 4.7% Ni - 0.3% C | " |
| 23 | 90% $(Ti_{0.9}, Cr_{0.1})$ $(N_{0.9}, C_{0.05}, O_{0.05})_{0.80}$ - 5% Ni - 5% Cr | " |

TABLE 4

| | Mechanical properties | | | Corrosion resistance | |
|---|---|---|---|---|---|
| Sample No. | Transverse rupture strength (Kg/mm$^2$) | Hardness (HRA) | Tone | Artificial sea-water | Artificial sweat |
| 14 | 100 | 90.2 | Gold color | Not color-changed nor corroded | Not color-changed nor corroded |
| 15 | 105 | 90.5 | " | Not color-changed nor corroded | Not color-changed nor corroded |
| 16 | 103 | 91.0 | Light gold color | Not color-changed nor corroded | Not color-changed nor corroded |

TABLE 4-continued

| Sample No. | Mechanical properties: Transverse rupture strength (Kg/mm²) | Hardness (HRA) | Tone | Corrosion resistance: Artificial sea-water | Artificial sweat |
|---|---|---|---|---|---|
| 17 | 100 | 90.3 | Gold color | Not color-changed nor corroded | Not color-changed nor corroded |
| 18 | 110 | 90.5 | Light gold color | Not color-changed nor corroded | Not color-changed nor corroded |
| 19 | 115 | 91.2 | " | Not color-changed nor corroded | Not color-changed nor corroded |
| 20 | 112 | 91.1 | " | Not color-changed nor corroded | Not color-changed nor corroded |
| 21 | 108 | 90.8 | Reddish light gold color | Extremely slightly color-changed | Not color-changed nor corroded |
| 22 | 117 | 91.2 | Gold color | Not color-changed nor corroded | Not color-changed nor corroded |
| 23 | 113 | 90.4 | " | Not color-changed nor corroded | Not color-changed nor corroded |

EXAMPLE 3

Sample Nos. 1, 5 and 8 sintered in Example 1 and Sample Nos. 15, 19 and 23 sintered in Example 2 were each subjected to an HIP treatment under conditions of 1500 bar and 1350° C., and they were then tested for mechanical properties, tone and corrosion resistance. Test results obtained are shown in Table 5.

TABLE 5

| Sample No. | Sample conditions | Mechanical properties: Transverse rupture strength (Kg/mm²) | Hardness (HRA) | Tone | Corrosion resistance: Artificial sea-water | Artificial sweat |
|---|---|---|---|---|---|---|
| 24 | HIP-treated Sample No. 1 | 110 | 90.5 | Gold color | Not color-changed nor corroded | Not color-changed nor corroded |
| 25 | HIP-treated Sample No. 5 | 115 | 91.1 | Gold color | Not color-changed nor corroded | Not color-changed nor corroded |
| 26 | HIP-treated Sample No. 8 | 120 | 90.8 | Gold color | Not color-changed nor corroded | Not color-changed nor corroded |
| 27 | HIP-treated Sample No. 15 | 110 | 90.6 | Gold color | Not color-changed nor corroded | Not color-changed nor corroded |
| 28 | HIP-treated Sample No. 19 | 120 | 91.0 | Gold color | Not color-changed nor corroded | Not color-changed nor corroded |
| 29 | HIP-treated Sample No. 23 | 125 | 90.5 | Gold color | Not color-changed nor corroded | Not color-changed nor corroded |

EXAMPLE 4

TiNz, TiC, TiO, Ti(Nw, Cx)z, Ti(Nw, Oy)z, Ti(Nw, Cx, Oy)z, (Tia, Mb)Nz, (Tia, Mb) (Nw, Cx)z, (Tia, Mb) (Nw, Oy)z and (Tia, Mb) (Nw, Cx, Oy)z were each blended with a metallic powder of the binding phase and a metallic powder of the strengthening phase in a predetermined proportion, and 2% by weight of paraffin was further added thereto as a lubricant. Each blend was ground in a ball mill in which acetone was used as a solvent. After drying, each resultant mixed powder was compacted at a pressure of 2 t/cm², and was then sintered under a vacuum of $10^{-3}$ to $10^{-4}$ mmHg and at a given temperature of 1400° to 1600° C. As need, each sample was subjected to a solid solution treatment in vacuo at a temperature of 1100° to 1250° C. for a period of 3 hours. Each sintered alloy thus obtained was polished by means of a diamond grinding wheel, and was tested for mechanical properties, tone and corrosion resistance in the same manner as in Example 1. Blend composition, sintering conditions and solid solution treatment conditions of each sample are shown in Table 6, and results of the mechanical properties, tone and corrosion resistance of each sample, which underwent the sintering treatment and the solid solution treatment, are presented in Table 7:

TABLE 6

| Sample No. | Blend composition (wt. %) | Sintering conditions | Solid solution treatment conditions |
|---|---|---|---|
| 30 | 47% $TiN_{0.85}$ - 47% TiO - 5.5% Ni - 0.5% P | 1450° C. - 1 hr | — |
| 31 | 90% $TiN_{0.70}$ - 4.5% TiC - 5.3% Ni - 0.1% B - 0.1% C | 1500° C. - 1 hr | — |
| 32 | 90% $Ti(N_{0.9}, C_{0.1})_{0.75}$ - 7.9% Ni - 2% Al - 0.1% C | " | 1150° C. - 3 hrs |
| 33 | 90% $Ti(N_{0.7}, O_{0.3})_{0.6}$ - 8.9% Ni - 1% Si - | 1450° C. - 1 hr | — |

TABLE 6-continued

| Sample No. | Blend composition (wt. %) | Sintering conditions | Solid solution treatment conditions |
|---|---|---|---|
| | 0.1% C | | |
| 34 | 90% $Ti(N_{0.8}, O_{0.2})_{0.7}$ - 7% Ni - 3% Mn | 1500° C. - 1 hr | — |
| 35 | 90% $Ti(N_{0.7}, C_{0.1}, O_{0.2})_{0.8}$ - 8% Ni - 2% Ti | " | 1200° C. - 3 hrs |
| 36 | 85% $(Ti_{0.9}, Z_{0.1})$ $N_{0.85}$ - 5% TiO - 8% Ni - 1% Ti - 1% Al | 1550° C. - 1 hr | 1150° C. - 3 hrs |
| 37 | 75% $(Ti_{0.8}, V_{0.2})$ $N_{0.75}$ - 5% TiC - 10% Ni - 5% Co - 5% Zr | " | — |
| 38 | 80% $(Ti_{0.7}, Ta_{0.3})$ $(N_{0.9}, C_{0.1})_{0.7}$ - 10% Ni - 5% Co - 5% V | 1500° C. - 1 hr | — |
| 39 | 93% $(Ti_{0.8}, Cr_{0.2})$ $(N_{0.9}, O_{0.1})_{0.8}$ - 5% Co - 1.9% Hf - 0.1% C | 1500° C. - 1 hr | — |
| 40 | 80% $(Ti_{0.7}, Nb_{0.3})$ $(N_{0.8}, C_{0.1}, O_{0.1})_{0.9}$ - 10% Ni - 5% Mo - 5% Nb | " | — |
| 41 | 90% $(Ti_{0.8}, Zr_{0.2})$ $(N_{0.8}, O_{0.2})_{0.8}$ - 5% Ni - 2% Cr - 3% Zr | 1550° C. - 1 hr | — |
| 42 | 89% $(Ti_{0.5}, Zr_{0.3}, Cr_{0.2})$ $N_{0.8}$ - 5% TiO - 5.5% Ni - 0.4% B - 0.1% C | " | — |

TABLE 7

| Sample No. | Mechanical properties: Transverse rupture strength ($Kg/mm^2$) | Hardness (HRA) | Tone | Corrosion resistance: Artificial sea-water | Corrosion resistance: Artificial sweat |
|---|---|---|---|---|---|
| 30 | 106 | 90.8 | Reddish gold color | Not color-changed nor corroded | Not color-changed nor corroded |
| 31 | 109 | 91.1 | Gold color | Not color-changed nor corroded | Not color-changed nor corroded |
| 32 | 105 | 91.0 | Reddish light gold color | Not color-changed nor corroded | Not color-changed nor corroded |
| 33 | 110 | 90.8 | Light gold color | Not color-changed nor corroded | Not color-changed nor corroded |
| 34 | 108 | 90.7 | Reddish light gold color | Not color-changed nor corroded | Not color-changed nor corroded |
| 35 | 110 | 91.3 | Reddish gold color | Not color-changed nor corroded | Not color-changed nor corroded |
| 36 | 110 | 90.3 | Gold color | Not color-changed nor corroded | Not color-changed nor corroded |
| 37 | 115 | 90.2 | Light gold color | Extremely slightly color-changed | Not color-changed nor corroded |
| 38 | 113 | 90.4 | " | Extremely slightly color-changed | Not color-changed nor corroded |
| 39 | 110 | 90.6 | Gold color | Not color-changed nor corroded | Not color-changed nor corroded |
| 40 | 115 | 90.9 | " | Not color-changed nor corroded | Not color-changed nor corroded |
| 41 | 100 | 91.0 | " | Not color-changed nor corroded | Not color-changed nor corroded |
| 42 | 107 | 91.2 | " | Not color-changed nor corroded | Not color-changed nor corroded |

EXAMPLE 5

Each powder of $Al_2O_3$, $Y_2O_3$, $ZrO_2$, MgO, NiO and $SiO_2$ and each of the powdery materials used in Example 4 were blended in a predetermined proportion, and were sintered in the same manner as in Example 4. Samples thus obtained were tested for mechanical properties, tone and corrosion resistance. Blend composition, sintering conditions and solid solution treatment conditions of each sample are shown in Table 8, and test results of the mechanical properties, tone and corrosion resistance regarding samples which underwent the sintering treatment and the solid solution treatment are presented in Table 9:

TABLE 8

| Sample No. | Blend composition (wt. %) | Sintering conditions | Solid solution treatment conditions |
|---|---|---|---|
| 43 | 85% $TiN_{0.85}$ - 5% TiO - 8% Ni - 1% $Y_2O_3$ - 1% Al | 1600° C. - 1 hr | 1150° C. - 3 hrs |
| 44 | 80% $Ti(N_{0.9}, C_{0.1})_{0.75}$ - 10% Ni - 5% Co - 2% MgO - 1% Al - 2% Ti | 1550° C. - 1 hr | " |
| 45 | 90% $Ti(N_{0.5}, C_{0.1}, O_{0.4})_{0.7}$ - 5% Ni - 3% $SiO_2$ - 1.9% Si - 0.1% C | 1600° C. - 1 hr | — |
| 46 | 90% $Ti(N_{0.7}, O_{0.3})_{0.6}$ - 4.9% Ni - 5% NiO - 0.1% C | 1500° C. - 1 hr | — |
| 47 | 90% $Ti(N_{0.7}, C_{0.1}, O_{0.2})_{0.8}$ - 5% Ni - 0.5% $ZrO_2$ - 4% Zr - 0.5% C | " | — |
| 48 | 90% $(Ti_{0.8}, Zr_{0.2})$ $(N_{0.8}, O_{0.2})_{0.8}$ - 4% Co - | 1550° C. - 1 hr | — |

TABLE 8-continued

| Sample No. | Blend composition (wt. %) | Sintering conditions | Solid solution treatment conditions |
|---|---|---|---|
| | 4% Ni - 2% $Al_2O_3$ | | |
| 49 | 80% $Ti(N_{0.8}, O_{0.2})_{0.70}$ - 5% ZrN - 5% Ni - 5% Mo - 5% $Al_2O_3$ | 1600° C. - 1 hr | — |
| 50 | 80% $Ti(N_{0.8}, O_{0.2})_{0.70}$ - 9% $Al_2O_3$ - 5% Ni - 5% Cr - 1% Al | " | 1200° C. - 3 hrs |

TABLE 9

| Sample No. | Mechanical properties: Transverse rupture strength ($Kg/mm^2$) | Hardness (HRA) | Tone | Corrosion resistance: Artificial sea-water | Artificial sweat |
|---|---|---|---|---|---|
| 43 | 100 | 91.2 | Gold color | Not color-changed nor corroded | Not color-changed nor corroded |
| 44 | 105 | 90.5 | " | Not color-changed nor corroded | Not color-changed nor corroded |
| 45 | 103 | 91.0 | Reddish light gold color | Not color-changed nor corroded | Not color-changed nor corroded |
| 46 | 110 | 91.2 | Light gold color | Not color-changed nor corroded | Not color-changed nor corroded |
| 47 | 107 | 90.9 | Gold color | Not color-changed nor corroded | Not color-changed nor corroded |
| 48 | 105 | 91.4 | " | Not color-changed nor corroded | Not color-changed nor corroded |
| 49 | 100 | 91.3 | Light gold color | Not color-changed nor corroded | Not color-changed nor corroded |
| 50 | 95 | 91.5 | " | Not color-changed nor corroded | Not color-changed nor corroded |

EXAMPLE 6

Each powder of AlN, $Si_3N_4$, BN and $Mo_2C$ and each of the powdery materials used in Example 4 were blended in a predetermined proportion, and were sintered in the same manner as in Example 4. Samples thus obtained were tested for mechanical properties, tone and corrosion resistance. Blend composition, sintering conditions and solid solution treatment conditions of each sample are shown in Table 10, and test results of the mechanical properties, tone and corrosion resistance regarding samples which underwent the sintering treatment and the solid solution treatment are presented in Table 11.

TABLE 10

| Sample No. | Blend composition (wt. %) | Sintering conditions | Solid solution treatment conditions |
|---|---|---|---|
| 51 | 46% $TiN_{0.85}$ - 46% TiO - 6% Ni - 1.5% AlN - 0.5% Al | 1600° C. - 1 hr | — |
| 52 | 90% $Ti(N_{0.9}, C_{0.1})_{0.75}$ - 6% Ni - 2% $Si_3N_4$ - 2% $Mo_2C$ | " | — |
| 53 | 90% $Ti(N_{0.7}, O_{0.3})_{0.6}$ - 5.9% Ni - 2% BN - 2% $Mo_2C$ - 0.1% C | 1550° C. - 1 hr | — |
| 54 | 90% $Ti(N_{0.7}, C_{0.1}, O_{0.2})_{0.8}$ - 6% Ni - 4% AlN | 1600° C. - 1 hr | — |
| 55 | 75% $Ti(N_{0.7}, C_{0.1}, O_{0.2})_{0.8}$ - 10% Ni - 5% Cr - 10% $Mo_2C$ | 1500° C. - 1 hr | — |
| 56 | 75% $Ti(N_{0.7}, C_{0.1}, O_{0.2})_{0.8}$ - 10% Ni - 10% $Mo_2C$ - 2.5% Ti - 2.5% Al | " | 1200° C. - 3 hrs |
| 57 | 80% $(Ti_{0.8}, Zr_{0.2})(N_{0.8}, O_{0.2})_{0.8}$ - 10% Ni - 5% Co - 4.5% BN - 0.5% C | 1450° C. - 1 hr | — |
| 58 | 80% $(Ti_{0.8}, V_{0.2})N_{0.75}$ - 4% TiO - 10% Ni - 2% AlN - 2% Al - 2% Ti | 1500° C. - 1 hr | 1200° C. - 3 hrs |
| 59 | 70% $(Ti_{0.8}, Cr_{0.2})(N_{0.9}, O_{0.1})_{0.8}$ - 10% Ni - 5% Co - 5% Cr - 10 $Mo_2C$ | 1450° C. - 1 hr | — |

TABLE 11

| Sample No. | Mechanical properties: Transverse rupture strength ($Kg/mm^2$) | Hardness (HRA) | Tone | Corrosion resistance: Artificial sea-water | Artificial sweat |
|---|---|---|---|---|---|
| 51 | 110 | 91.0 | Gold color | Not color-changed nor corroded | Not color-changed nor corroded |
| 52 | 115 | 90.8 | " | Not color-changed nor corroded | Not color-changed nor corroded |
| 53 | 105 | 91.4 | Light gold color | Not color-changed | Not color-changed |

TABLE 11-continued

| Sample No. | Mechanical properties: Transverse rupture strength (Kg/mm²) | Hardness (HRA) | Tone | Corrosion resistance: Artificial sea-water | Artificial sweat |
|---|---|---|---|---|---|
| | | | | nor corroded | nor corroded |
| 54 | 108 | 91.5 | Gold color | Not color-changed nor corroded | Not color-changed nor corroded |
| 55 | 110 | 90.8 | " | Not color-changed nor corroded | Not color-changed nor corroded |
| 56 | 115 | 91.2 | " | Not color-changed nor corroded | Not color-changed nor corroded |
| 57 | 107 | 91.0 | " | Not color-changed nor corroded | Not color-changed nor corroded |
| 58 | 113 | 90.7 | Light gold color | Not color-changed nor corroded | Not color-changed nor corroded |
| 59 | 117 | 90.5 | Gold color | Not color-changed nor corroded | Not color-changed nor corroded |

EXAMPLE 7

Sample Nos. 30, 37 and 42 sintered in Example 4, Sample Nos. 45 and 48 sintered in Example 5, and Sample Nos. 51, 54 and 59 sintered in Example 6 were each subjected to an HIP treatment under conditions of 1500 bar and 1350° C., and were then tested for mechanical properties, tone and corrosion resistance. Obtained test results are shown in Table 12:

TABLE 12

| Sample No. | Sample conditions | Mechanical properties: Transverse rupture strength (Kg/mm²) | Hardness (HRA) | Tone | Corrosion resistance: Artificial sea-water | Artificial sweat |
|---|---|---|---|---|---|---|
| 60 | HIP-treated Sample No. 30 | 115 | 90.9 | Gold color | Not color-changed nor corroded | Not color-changed nor corroded |
| 61 | HIP-treated Sample No. 37 | 120 | 90.3 | Gold color | Not color-changed nor corroded | Not color-changed nor corroded |
| 62 | HIP-treated Sample No. 42 | 113 | 91.1 | Gold color | Not color-changed nor corroded | Not color-changed nor corroded |
| 63 | HIP-treated Sample No. 45 | 110 | 90.9 | Gold color | Not color-changed nor corroded | Not color-changed nor corroded |
| 64 | HIP-treated Sample No. 48 | 113 | 91.5 | Gold color | Not color-changed nor corroded | Not color-changed nor corroded |
| 65 | HIP-treated Sample No. 51 | 116 | 91.1 | Gold color | Not color-changed nor corroded | Not color-changed nor corroded |
| 66 | HIP-treated Sample No. 54 | 115 | 91.4 | Gold color | Not color-changed nor corroded | Not color-changed nor corroded |
| 67 | HIP-treated Sample No. 59 | 123 | 90.4 | Gold color | Not color-changed nor corroded | Not color-changed nor corroded |

EXAMPLE 8

Samples having a size of 6$\phi$×20 mm of the sintered alloy for decoration according to this invention were prepared by sintering compacts each having a blend composition of 85% $Ti(N_{0.5}, O_{0.5})_{0.78}$−10% $(Ta_{0.3}, V_{0.7})C$−5% Ni (Sample No. 68) and of 75% $Ti(N_{0.5}, O_{0.5})_{0.78}$−20% $(Ta_{0.3}, V_{0.7})C$−5% Ni (Sample No. 69), in the same manner as in Example 1, respectively.

On the other hand, Referential samples having a size of 6$\phi$×20 mm were prepared by coating TiN, by means of the sputtering process, on the surface of a stainless steel (JIS standard; SUS 304, Sample No. 70) or of a high speed steel (JIS standard; SKH-9, Sample No. 71), or by coating TiN on the surface of a WC−6% Co cemented carbide alloy (Sample No. 72) by means of the chemical deposition process, respectively.

With the mirror-finished peripheral surface of each sample having a diameter of 20 mm was contacted a nylon series fishing line having a size of 1$\phi$×2,000 mm, and part of the fishing line was set so as to be soaked in an artificial sea-water all the time. Then, abrasion resistance and corrosion resistance to the artificial sea-water at the sliding portion, of each sample, were examined by fixing the sample and setting the fishing line in such a manner that the rotating and moving the fishing line is slidden and worn at the contact surface.

The results of the examination and the characteristics of each sample are shown in Table 13.

TABLE 13

| Sample No. | Hardness (Hv) | Tone | Wear resistance and corrosion resistance: Width of string groove after $10^5$ time sliding | Corrosion resistance |
|---|---|---|---|---|
| 68 | 1382 | Gold color | 1.5 μm | Good |
| 69 | 1477 | Light gold color | 1.0 μm | " |
| 70 | 450 | Grayish white color | 90 μm at 3000 times | Color-changed |
| 71 | 850 | Gold color | 60 μm at 5000 times and peeled off in some places | Slightly color-changed |
| 72 | 1653 | Gold color | 1.5 μm and slightly peeled off | Irregular tone produced |

As be definite from the aforementioned results, it has been found that the sintered alloy for decoration according to this invention has together decorativeness suitable for decorative members as well as excellent corrosion resistance and mechanical properties.

What is claimed is:

1. A sintered alloy for decoration which consists essentially of:

(A) 2 to 30% by weight of a binding phase comprising one or more elements selected from the group consisting of Fe, Ni, Co, Cr, Mo and W;

(B) 0 to 10% by weight of a strengthening phase comprising at least one material selected from the group consisting of metal, an alloy, a metal oxide, a metal nitride and a metal carbide;

(C) a hard phase represented by the formula:

$$(Ti_a, M_b)(N_w, C_x, O_y)_z$$

wherein M is one or more elements selected from the group consisting of Zr, Hf, V, Nb, Ta and Cr; a is a atomic ratio of Ti; b is an atomic ratio of a metal represented by M; $a+b=1$; $1 \geqq a \geqq 0.4$; $0.6 \geqq b \geqq 0$; N is nitrogen; C is carbon; O is oxygen; w, x and y are atomic ratios of nitrogen, carbon and oxygen, respectively; z is a ratio of non-metallic elements with respect to the metals; $w+x+y=1$; $x+y>0$; $1 \geqq w \geqq 0.4$; $0.15 \geqq x \geqq 0$; $0.6 \geqq y \geqq 0$; and $0.95 \geqq z \geqq 0.6$; and (D) inevitable impurities, wherein said colored sintered alloy (i) is the product of a sintering process that uses, as a starting material, a titanium compound which has a substoichiometric composition, such that nitrogen gas liberated during said sintering process nitrogenizes said titanium compound, and (ii) contains an amount of carbon, calculated with the sum of said strengthening phase and said hard phase taken as 100%, that is no greater than 4.2 atomic %.

2. A sintered alloy for decoration according to claim 1, wherein said strengthening phase comprises one or more metals selected from the group consisting of P, Al, B, Si, Mn, Ti, Zr, Hf, V, Nb, Ta and one or more alloys thereof.

3. A sintered alloy for decoration according to claim 1, wherein said strengthening phase comprises one or more oxides selected from the group consisting of $Al_2O_3$, $Y_2O_3$, $ZrO_2$, MgO, NiO and $SiO_2$.

4. A sintered alloy for decoration according to claim 1, wherein said strengthening phase comprises one or more nitrides or carbides selected from the group consisting of AlN, $Si_3N_4$, BN and, $Mo_2C$ and one or more compounds thereof.

5. A sintered alloy for decoration according to claim 1, wherein said titanium compound is represented by the formula TiNz, wherein z is as defined in claim 1.

6. A decorative metal member comprised of a colored sintered alloy consisting essentially of:

(A) 2 to 30% by weight of a binding phase comprising one or more elements selected from the group consisting of Fe, Ni, Co, Cr, Mo and W;

(B) 0 to 10% by weight of a strengthening phase comprising at least one material selected from the group consisting of metal, an alloy, a metal oxide, a metal nitride and a metal carbide;

(C) a hard phase represented by the formula:

$$(Ti_a, M_b)(N_w, C_x, O_y)_z$$

wherein M is one or more elements selected from the group consisting of Zr, Hf, V, Nb, Ta and Cr; a is a atomic ratio of Ti; b is an atomic ratio of a metal represented by M; $a+b=1$; $1 \geqq a \geqq 0.4$; $0.6 \geqq b \geqq 0$; N is nitrogen; C is carbon; O is oxygen; w, x and y are atomic ratios of nitrogen, carbon and oxygen, respectively; z is a ratio of non-metallic elements with respect to the metals; $w+x+y=1$; $x+y>0$; $1 \geqq w \geqq 0.4$; $0.15 \geqq x \geqq 0$; $0.6 \geqq y \geqq 0$; and $0.95 \geqq z \geqq 0.6$; and (D) inevitable impurities, wherein said colored sintered alloy (i) is the product of a sintering process that uses, as a starting material, a titanium compound which has a substoichiometric composition, such that nitrogen gas liberated during said sintering process nitrogenizes said titanium compound, and (ii) contains an amount of carbon, calculated with the sum of said strengthening phase and said hard phase taken as 100%, that is no greater than 4.2 atomic %.

7. A decorative metal member according to claim 6, wherein said sintered alloy retains a gold color tone.

8. A decorative metal member according to claim 6, wherein said titanium compound is represented by the formula TiNz, wherein z is as defined in claim 1.

* * * * *